US005201785A

United States Patent [19]

Nagano

[11] Patent Number: 5,201,785

[45] Date of Patent: Apr. 13, 1993

[54] DISC-HOLDER ASSEMBLY

[75] Inventor: Yasuhiko Nagano, Sagamihara, Japan

[73] Assignee: Minnesota Mining & Manufacturing Company, St. Paul, Minn.

[21] Appl. No.: 827,894

[22] Filed: Jan. 30, 1992

Related U.S. Application Data

[63] Continuation of Ser. No. 698,469, May 10, 1991, abandoned.

[51] Int. Cl.[5] ..... B24D 17/00

[52] U.S. Cl. ..... 51/358; 51/376; 51/382; 51/406

[58] Field of Search ..... 51/358, 376, 377, 382, 51/383, 384, 406, 407

[56] References Cited

U.S. PATENT DOCUMENTS

| | | | |
|---|---|---|---|
| 2,991,596 | 7/1961 | Walters | 51/376 |
| 3,346,904 | 10/1967 | Armstrong | 15/230.12 |
| 3,436,875 | 4/1969 | Cheney | 51/376 |
| 3,522,681 | 8/1970 | Lampert | 51/358 |
| 3,703,739 | 11/1972 | Young et al. | 15/230.17 |
| 3,883,998 | 5/1975 | Dosser | 51/376 |
| 4,437,269 | 3/1984 | Shaw | 51/358 |
| 4,541,207 | 9/1985 | Antonson | 9/8 |
| 4,910,826 | 3/1990 | Rones | 15/230 |

FOREIGN PATENT DOCUMENTS

| | | |
|---|---|---|
| 0095015 | 2/1983 | European Pat. Off. . |
| 0127812 | 5/1984 | European Pat. Off. . |

*Primary Examiner*—M. Rachuba

*Attorney, Agent, or Firm*—Gary L. Griswold; Walter N. Kirn; Jeffrey L. Wendt

[57] ABSTRACT

A disc holder assembly having a disc holder and a surface finishing disc member. The disc holder has a lower circular surface which includes a coaxial concave portion having a projection extending downwards from its center, a planar portion extending outward from the outer edge of the concave portion, and a sheet fastening member fixed to the planar annular surface. The projection includes a shaft portion and a distal head portion of larger diameter than the shaft portion. The surface finishing disc includes a surface finishing layer (e.g., coated abrasive sheet) on its lower surface, a sheet fastening member on its opposite surface and a central opening of the same diameter of the shaft portion of the projection. The opening of the disc member is forced over the head portion of the projection so that the sheet fastening members are secured as they contact to firmly hold the disc member within the disc holder.

4 Claims, 2 Drawing Sheets

DISC-HOLDER ASSEMBLY

This is a continuation of application Ser. No. 07/698,469 filed May 10, 1991, now abandoned.

FIELD OF THE INVENTION

The present invention relates to a disc holder assembly of a rotary finishing device suitable for use in finishing surfaces of, for example, metallic members. More particularly, the invention is concerned with an improvement in a disc holder having a double-sided sheet fastener supplied, for example, by mating hook and loop fastening members.

BACKGROUND OF THE INVENTION

In a typical conventional surface finishing disc holder assembly, a surface finishing disc such as an abrasive disc is fixed to a holder by means of screws. Also known is a disc holder assembly in which, as shown in FIG. 3 of the drawing, a disc holder 30 and an abrasive disc 40 are detachably secured to each other by means of sheet fasteners 31 and 34 attached to the disc holder 30 and abrasive sheet 41, respectively. Examples of related devices are disclosed in U.S. Pat. Nos. 3,346,904, 3,522,681, 3,703,739 and 4,910,826. Sheet fasteners of the mating sheets of hook and loop fasteners such as that sold under the trade designation "Velcro" have been used as has been a sheet of pressure sensitive adhesive (psa) and a sheet to which it will adhere and permit easy removal.

Also known is a surface finishing disc holder assembly which employs bolts and nuts for securing an abrasive disc to the disc holder. Such a prior art disc holder assembly requires a tool for attaching and detaching the abrasive disc to and from the disc holder. The work of attaching and detaching the abrasive disc is quite laborious and time-consuming. On the other hand, the known disc holder assembly relying upon sheet fasteners alone suffers from a problem in that the center of the abrasive disc tends to be offset from the center of the disc holder or the abrasive disc comes off the disc holder during high-speed rotation due to inadequate attachment between the fastener sheets. Even though this type of disc holder assembly permits easy attaching and detaching of the abrasive disc, it does not provide an easy way to correctly center the abrasive disc with respect to the disc holder during the assembly.

SUMMARY OF THE INVENTION

Figure 1:
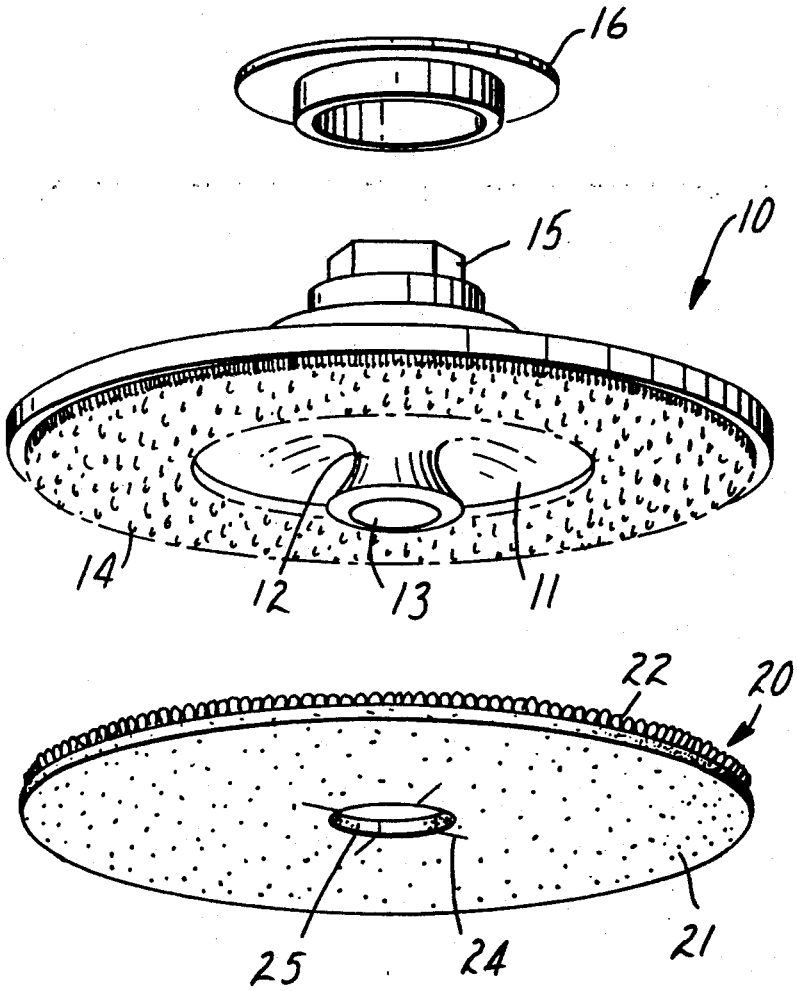
FIG. 1 is an exploded view of an embodiment of a surface finishing disc holder assembly of the present invention.

The present invention provides a surface finishing disc holder assembly which permits easy attaching and detaching of a surface finishing disc, easily centers the disc and exhibits a holding force high enough to prevent displacement or unintentional removal of the surface finishing disc during high-speed rotation.

The disc holder assembly comprises a disc holder including means for attachment to a rotary tool and a disc member. The disc member includes a central opening, a surface finishing member such as a sheet of coated abrasive or non-woven abrasive on one surface and a first hook or loop sheet fastener on a second surface opposite to the first surface. The disc holder has a lower surface which includes a concave portion coaxially within a flat annular surface portion, a mounting projection extending downwards from a center portion of the concave portion. The mounting projection has a shaft portion which has a shaft portion diameter and a distal head portion which has a head portion diameter which is somewhat larger than the shaft portion diameter, and a second hook or loop sheet fastener adapted to be detachably secured to the first sheet fastener fixed to the annular surface. The disc member central opening has a diameter which is substantially the same as the shaft portion diameter but which will elastically expand to permit the forced entry of the distal head portion. The disc member is capable of being mounted with the first and second sheet fasteners detachably secured and the distal portion head protruding through the disc central opening with it aligned around the shaft portion of the mounting projection to securely hold disc member with the surface finishing member deployed in a plane for use. The mounting projection distal head extends to a point which is located inwards from the plane.

Preferably, the opening formed in the disc member is provided with at least one slit extending radially outwardly therefrom. The sheet fasteners are provided by a set of sheets including one sheet of hook fasteners and one sheet of loop fasteners. Such fastener materials are available under the trade designation "Velcro" or "Scotchmate".

In the surface finishing disc holder assembly having the described construction, when the surface finishing disc member is attached to the disc holder, the head portion of the projection on the disc holder member is inserted into the opening in the surface finishing disc member. Since the head portion has a greater diameter than the opening, the surface finishing disc member is elastically deformed to expand the opening to allow the head portion to pass through the opening. The sheet fastener on the surface finishing disc member and the sheet fastener on the disc holder engage with each other to couple these members and, simultaneously, the head portion is firmly gripped by the edge of the opening in the surface finishing disc member.

For detaching the surface finishing disc member from the disc holder, the user simply pulls the disc member to separate the hook or loop sheet fasteners on the disc holder and the disc member, so that both sheet fasteners are disengaged from each other. At the same time, the opening in the disc member is elastically spread so as to release the head portion, whereby the disc grinding member is detached from the disc holder. One advantage of the invention is that the hook and loop fasteners do not substantially change in "adhesion" or degrade in harsh environments, as hook and loop fasteners are mechanical in nature, rather than chemical. Thus, the increase in psa adhesion as a function of dwell time is eliminated.

DETAILED DESCRIPTION OF THE PRESENTLY PREFERRED EMBODIMENT

Figure 2:
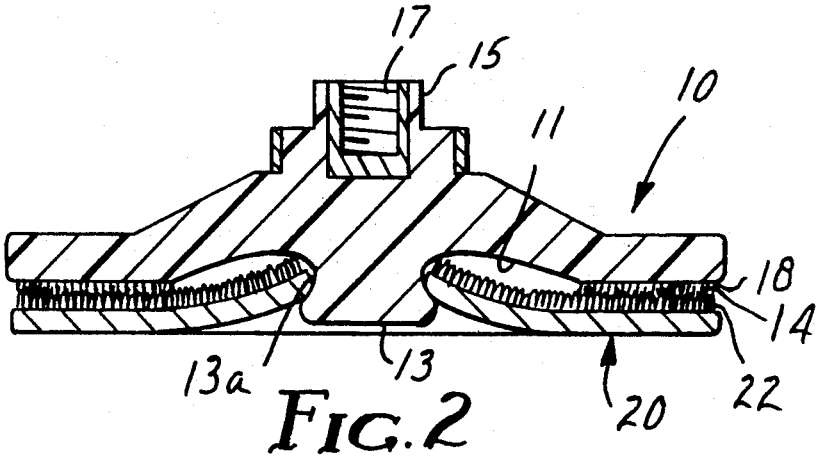
FIG. 2 is a vertical sectional view of the embodiment of the assembly depicted in FIG. 1 but in the assembled state.
Figure 3:
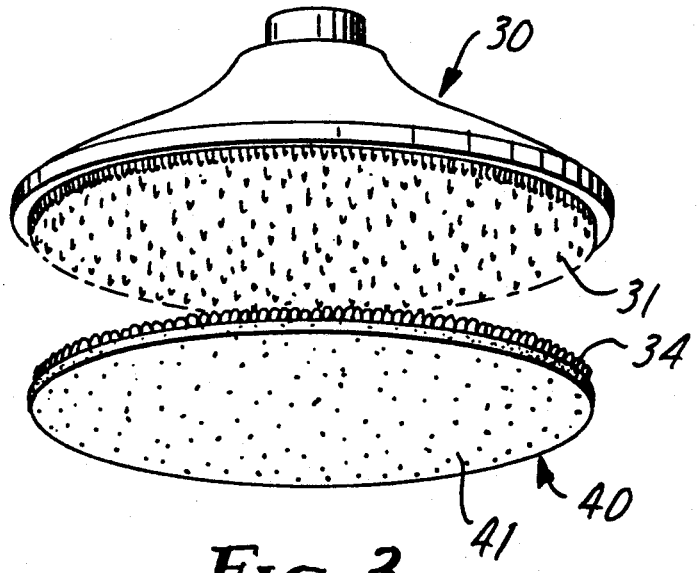
FIG. 3 PRIOR ART
FIG. 3 is an exploded illustration of a prior art surface finishing assembly.

As shown in FIGS. 1 and 2, a disc-shaped disc holder 10, which may be made of hard molded plastic, is provided on the upper side thereof with a mounting hub 15 for receiving and fixing a drive shaft (not shown). A female screw member 17 made, for example, of a metallic material is fixed in the mounting hub 15. A removable cap 16 may be mounted in such a manner as to surround and protect the mounting hub 15. Removing cap 16 enables the disc holder to be attached to the shaft of the rotary device (not shown) such as a sander or grinder.

The disc holder 10 includes a substantially hemispherical recess or concave portion 11 on its lower surface which is concentric within the lower surface of holder 10. Flat annular portion 18 surrounds concave portion 11 in the lower surface of disc holder 10. A mounting projection 12 is secured to the center of concave portion 11 so as to project downwards therefrom. Mounting projection 12 has a distal head portion 13 of a diameter slightly greater than the diameter of shaft portion 13*a* on which distal head portion 13 is mounted.

A hook sheet 14 of a sheet fastener is fixed to flat annular portion 18 of the lower surface of the disc holder 10 around hemispherical concave portion 11. The head portion 13 projects slightly downwards to a point which does not extend as far as the abrasive face of abrasive sheet 21 of disc 20 when it is secured on disc holder 10.

Disc member 20 has a lower surface which may be provided by a flexible abrasive sheet 21 and an upper surface provided by a loop sheet 22 engageable with the hook sheet 14 on the disc holder. The hook sheet 14 and the loop sheet 22 in cooperation provide a sheet fastener. An opening 23 of a diameter substantially the same as the diameter of shaft portion 13*a* of mounting projection 12 but smaller than the diameter of head portion 13 is formed in the center of disc member 20. In order to facilitate insertion of the head portion 13 into the opening 23, comparatively short radial slits 24 are preferably formed so as to extend radially outwardly from the edge of opening 23.

One example employs a disc member which has an outside diameter of about 100 mm, a thickness ranging between 5 and 10 mm, and an opening 23 diameter of about 15 mm. The arrangement may be modified such that the loop sheet and the hook sheet of the sheet fastener may be provided on the disc holder and the disc member, respectively.

FIG. 2 shows disc member 20 attached to disc holder 10. The attaching of disc member 20 to the disc holder 10 is conducted in the following procedure. As the first step, the disc member 20 is placed such that both sheets of the sheet fasteners face each other, with the opening 23 in the disc member 20 aligned with the head portion 13 on mounting projection 12 of the disc holder 12. Then, the user presses, by his finger(s), the portion of the disc member around the opening. Since the diameter of the opening 23 is slightly smaller than the diameter of the head portion 13, the edge of the opening 23 is slightly elastically deformed to increase the diameter of the opening 23, whereby the head portion 13 is forcibly inserted into the opening 23 so as to be firmly gripped by the edge of the opening 23. Instead of pressing the disc member directly by the user's finger(s), the open end of the cap 16 shown in FIG. 1 may be pressed against disc 20 to apply a force to a region around the opening. The inside diameter of the open end of the cap 16 is dimensioned to be slightly greater than the outside diameter of the head portion of the disc holder, so that it can fully drive the head portion 13 into the opening 23.

In the state after attaching of the disc member to the disc holder, since the diameter of the opening 23 in the disc member is substantially the same as the diameter of shaft 13*a* of the projection 12 on the disc holder 10, the portion of the disc holder around the opening 23 is firmly clamped between the projection 12 and the lower surface of the disc holder 10 and is retained by the head portion 13 of the projection. The projection 12 and the head portion 13 are so sized that the head portion 13 does not project beyond the working face (e.g. abrasive face) of the disc member.

According to the invention, it is preferred that the following conditions (1) and (2) are met:

$$\tfrac{1}{3} \leq B/A \leq 4/5 \quad (1)$$

$$\tfrac{1}{3} \leq D/C \leq \tfrac{1}{2} \quad (2)$$

where,

A is the length of the mounting projection, i.e., the distance between the end of the head portion 13 and the bottom of the concave portion of the disc holder;

B is the vertical distance between the outer surface of the sheet fastener 14 and the bottom of the concave portion of the disc holder;

C is the distance between the central axis of the disc holder and the outer peripheral edge of the sheet fastener 14; and D is the distance between the central axis of the disc holder and the inner peripheral edge of the sheet fastener 14.

The disc holder assembly of the present invention having the described feature permits an easy and prompt attaching and detaching of the disc member without requiring the troublesome work of lifting the entire disc away from the disc holder for centering the abrasive. Furthermore, a high holding force is obtained for holding a surface finishing member such as a coated abrasive sheet or non-woven abrasive pad, thus eliminating any risk for the disc to be offset or to come off the disc holder even when the device is operated at high speed.

In view of the foregoing description, it will be apparent that the invention is not limited to the specific details set forth herein for purposes of illustration, and that various other modifications are equivalent for the stated and illustrated functions without departing from the spirit of the invention in the scope thereof as defined in the appended claims.

What is claimed is:

1. A disc holder assembly comprising: a disc holder including means for attachment to a rotary tool and a disc member, said disc member including a surface finishing member on a first surface, a first sheet fastener on a second surface opposite to said first surface, and a central opening extending through said first and second surfaces and extending through said surface finishing member and said first sheet fastener, said disc holder having a lower surface which includes a concave portion coaxially within a flat annular surface portion, a mounting projection extending downwards from a center portion of said concave portion having a shaft portion having a shaft portion diameter and a distal head portion having a head portion diameter which is somewhat larger than said shaft diameter, and a second sheet fastener adapted to be detachably secured to said first sheet fastener fixed to said annular surface, said disc member central opening having a diameter which is substantially the same as said shaft portion diameter but which will elastically expand to permit the forced entry of said distal head portion, said central opening having at least one slit which extends from the edge of said opening outwards, said disc member being capable of being mounted with said first and second sheet fasteners detachably secured and said distal portion head protruding through said disc central opening with said disc central opening aligned around said shaft portion of said mounting projection to securely hold said disc member with said surface finishing member deployed in a plane for use, and with the mounting projection distal head extending to a point which is located inwards from said plane, wherein one of said sheet fasteners is a hook fastener sheet and the other of said sheet fasteners is a loop fastener sheet.

2. The disc holder assembly according to claim 1, wherein said surface finishing member is a sheet of coated abrasive.

3. The disc holder assembly of claim 1 wherein said surface finishing member is a nonwoven abrasive.

4. The disc holder assembly of claim 1 wherein $$\frac{3}{5} \leqq B/A \leqq 4/5$$

and $$\frac{1}{3} \leqq D/C \leqq \frac{2}{3}$$

wherein,

A is the length of the mounting projection;

B is a vertical distance between an outer surface of the second sheet fastener and a bottom of the concave portion of the disc holder;

C is the distance between the central axis of the disc holder and an outer peripheral edge of the second sheet fastener; and D is the distance between the central axis of the disc holder and an inner peripheral edge of the second sheet fastener.

* * * * *

UNITED STATES PATENT AND TRADEMARK OFFICE

CERTIFICATE OF CORRECTION

PATENT NO. : 5,201,785

DATED : April 13, 1993

INVENTOR(S) : Yasuhiko Nagano

It is certified that error appears in the above-indentified patent and that said Letters Patent is hereby corrected as shown below:

On the title page, item [30] should be inserted as follows:

-- Foreign Application Priority Data
May 25, 1990 [JP] Japan 2-54180--

Signed and Sealed this

Tenth Day of May, 1994

Bruce Lehman

*Attest:*

BRUCE LEHMAN

*Attesting Officer*

*Commissioner of Patents and Trademarks*